US007353175B2

(12) United States Patent
Kaneko

(10) Patent No.: US 7,353,175 B2
(45) Date of Patent: Apr. 1, 2008

(54) APPARATUS, METHOD, AND PROGRAM FOR SPEECH SYNTHESIS WITH CAPABILITY OF PROVIDING WORD MEANING IMMEDIATELY UPON REQUEST BY A USER

(75) Inventor: Kazue Kaneko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 787 days.

(21) Appl. No.: 10/376,205

(22) Filed: Mar. 4, 2003

(65) Prior Publication Data

US 2003/0212560 A1 Nov. 13, 2003

(30) Foreign Application Priority Data

Mar. 7, 2002 (JP) ..... 2002-062298

(51) Int. Cl.
*G10L 13/00* (2006.01)

(52) U.S. Cl. ..... 704/260; 704/277

(58) Field of Classification Search ..... 704/260, 704/277

See application file for complete search history.

(56) References Cited

U.S. PATENT DOCUMENTS 4,890,230 A * 12/1989 Tanoshima et al. ..... 704/3
4,998,241 A * 3/1991 Brox et al. ..... 370/288
5,351,189 A * 9/1994 Doi et al. ..... 704/3
5,541,838 A * 7/1996 Koyama et al. ..... 704/4
5,575,659 A * 11/1996 King et al. ..... 434/167
5,577,164 A 11/1996 Kaneko et al. ..... 395/2.84
5,623,609 A * 4/1997 Kaye et al. ..... 704/1
6,408,266 B1 * 6/2002 Oon ..... 704/1
6,704,699 B2 * 3/2004 Nir ..... 704/2

FOREIGN PATENT DOCUMENTS

| | | |
|---|---|---|
| JP | 63-231396 | 9/1988 |
| JP | 5-22487 | 1/1993 |
| JP | 10-105192 | 4/1998 |
| JP | 10-134068 | 5/1998 |
| JP | 10-171485 | 6/1998 |
| JP | 2000-267687 | 9/2000 |
| JP | 2002-259373 | 2/2002 |

* cited by examiner

*Primary Examiner*—Michael Opsasnick
(74) *Attorney, Agent, or Firm*—Fitzpatrick, Cella, Harper & Scinto

(57) ABSTRACT

A word meaning explanation request to a word in document data, which is output as speech, is input from a user instruction input unit. When the word meaning explanation request is input, a text analysis unit analyzes already output document data, which is output as speech immediately before the word meaning explanation request is input. A word meaning search unit searches for a word meaning comment corresponding to a word meaning explanation request objective word obtained based on the analysis result. The word meaning comment is output.

14 Claims, 4 Drawing Sheets

FIG. 3

READING TEXT

The issue of this incident is whether the accused had murderous intention. The last discussion will be made on 39th tomorrow

TEXT-TO-SPEECH READING

The issue of this incident is whether the accused had...

WORD MEANING EXPLANATION REQUEST

WORD MEANING EXPLANATION 1 (INPUT POSITION OF WORD MEANING EXPLANATION REQUEST)

'have' IS VERB WHICH MEANS HAVE OR POSSESS SOMETHING.

WORD MEANING EXPLANATION 2 (ESTIMATE OBJECTIVE WORD BY TRACING TEXT FROM INPUT POSITION OF WORD MEANING EXPLANATION REQUEST)

The issue of this incident is whether the accused

'accused' MEANS THE DEFENDANT IN A CRIMINAL CASE.

WORD MEANING EXPLANATION 3 (READ ALOUD TEXT AGAIN, AND ACCEPT ANOTHER WORD MEANING EXPLANATION REQUEST)

The issue of this incident is whether the accused

WORD MEANING EXPLANATION REQUEST

'accused' MEANS THE DEFENDANT IN A CRIMINAL CASE.

APPARATUS, METHOD, AND PROGRAM FOR SPEECH SYNTHESIS WITH CAPABILITY OF PROVIDING WORD MEANING IMMEDIATELY UPON REQUEST BY A USER

FIELD OF THE INVENTION

The present invention relates to a speech synthesis apparatus and method, and a program, which output document data as speech.

BACKGROUND OF THE INVENTION

Conventionally, as a reference function of words in document data managed by a computer, an online dictionary that can be used by cutting and pasting a character string on a display is known. Also, a word reference function that uses a link function of hypertext or the like is known. Some of these reference functions issue a reference request to a character code or the display position of character information displayed as a two-dimensional image.

In "Speech synthesis apparatus" of Japanese Patent Application Laid-Open No. 10-171485 and "Japanese text reading word edit processing method" of Japanese Patent Application Laid-Open No. 5-22487, text is read aloud after words which are hard for the user to understand, and those which are misleading due to having a multiplicity of meanings, are replaced by other words or meanings in advance.

Also, in "Information acquisition support method and apparatus" of Japanese Patent Application Laid-Open No. 10-134068, speech is output while displaying a document, words in the displayed document are registered as a recognition vocabulary for speech recognition, and the meaning and example of a word uttered by the user are presented.

The above examples of the online dictionary and hypertext are premised on the display of document data, and the user designates a word to be examined using a character code or position information in the document data. For this reason, these examples are not premised on the display of document data that contains words to be referred to, and cannot be used to designate a word on the condition that the user acquires information only by speech.

In the methods of Japanese Patent Application Laid-Open Nos. 10-171485 and 5-22487, in which text is read after words which are hard for the user to understand, and those which are misleading due to having a multiplicity of meanings, are replaced by other words or meanings in advance, original document data is modified. Therefore, such methods are not suitable for document data such as literary works, the originality of which must be appreciated. When words are replaced by plain ones from the start while the user is listening to document data for the purpose of language learning, the original purpose of learning is not achieved.

Furthermore, in the method of Japanese Patent Application Laid-Open No. 10-134068, which recognizes a word uttered by the user as speech, and presents the meaning and example of that word, if the user fails to catch speech, he or she can no longer designate that word.

In addition, in consideration of use that allows a mobile user who wears a headphone to listen to speech such as from a portable audio device, a function of allowing the user to indicate a given portion for which he or she wants some clarification, without always paying attention to the display, is required.

SUMMARY OF THE INVENTION

The present invention has been made to solve the conventional problems, and has as its object to provide a speech synthesis apparatus and method, and a program which can easily and efficiently provide the meaning of a word in output text.

According to the present invention, the foregoing object is attained by providing a speech synthesis apparatus for outputting document data as speech, comprising:

input means for inputting a word meaning explanation request to a word in the document data which is output as speech;

analysis means for, when the word meaning explanation request is input, analyzing already output document data, which is output as speech immediately before the word meaning explanation request is input;

search means for searching for a word meaning comment corresponding to a word meaning explanation request objective word obtained based on an analysis result of the analysis means; and output means for outputting the word meaning comment.

In a preferred embodiment, the analysis means determines a word, which is output as speech immediately before the word meaning explanation request, as the word meaning explanation request objective word.

In a preferred embodiment, the analysis means estimates a word meaning explanation request objective word from a word group other than a predetermined word in the already output document data.

In a preferred embodiment, the predetermined word is a word having a word meaning explanation inapplicable flag.

In a preferred embodiment, the predetermined word is a word having a part of speech other than at least a noun.

In a preferred embodiment, when the word meaning explanation request is input, the output means re-outputs the already output document data at an output speed lower than a previous output speed, and the analysis means analyzes the already output document data on the basis of a word meaning explanation request input with respect to the already output document data, which is re-output.

In a preferred embodiment, the output means outputs the word meaning comment as speech.

In a preferred embodiment, the output means displays the word meaning comment as text.

According to the present invention, the foregoing object is attained by providing a speech synthesis method for outputting document data as speech, comprising:

an input step of inputting a word meaning explanation request to a word in the document data which is output as speech;

an analysis step of analyzing, when the word meaning explanation request is input, already output document data, which is output as speech immediately before the word meaning explanation request is input;

a search step of searching for a word meaning comment corresponding to a word meaning explanation request objective word obtained based on an analysis result of the analysis step; and an output step of outputting the word meaning comment.

According to the present invention, the foregoing object is attained by providing a program for making a computer implement speech synthesis for outputting document data as speech, comprising:

a program code of an input step of inputting a word meaning explanation request to a word in the document data which is output as speech;

a program code of an analysis step of analyzing, when the word meaning explanation request is input, already output document data, which is output as speech immediately before the word meaning explanation request is input;

a program code of a search step of searching for a word meaning comment corresponding to a word meaning explanation request objective word obtained based on an analysis result of the analysis step; and a program code of an output step of outputting the word meaning comment.

Further objects, features and advantages of the present invention will become apparent from the following detailed description of embodiments of the present invention with reference to the accompanying drawings.

BRIEF DESCRIPTION OF THE DRAWINGS

FIG. 3 is a view for explaining an example of the operation of a text analysis unit 105 for a word meaning explanation request objective word in the embodiment of the present invention.

DETAILED DESCRIPTION OF THE PREFERRED EMBODIMENTS

An embodiment of the present invention will be described in detail hereinafter with reference to the accompanying drawings.

Figure 1:
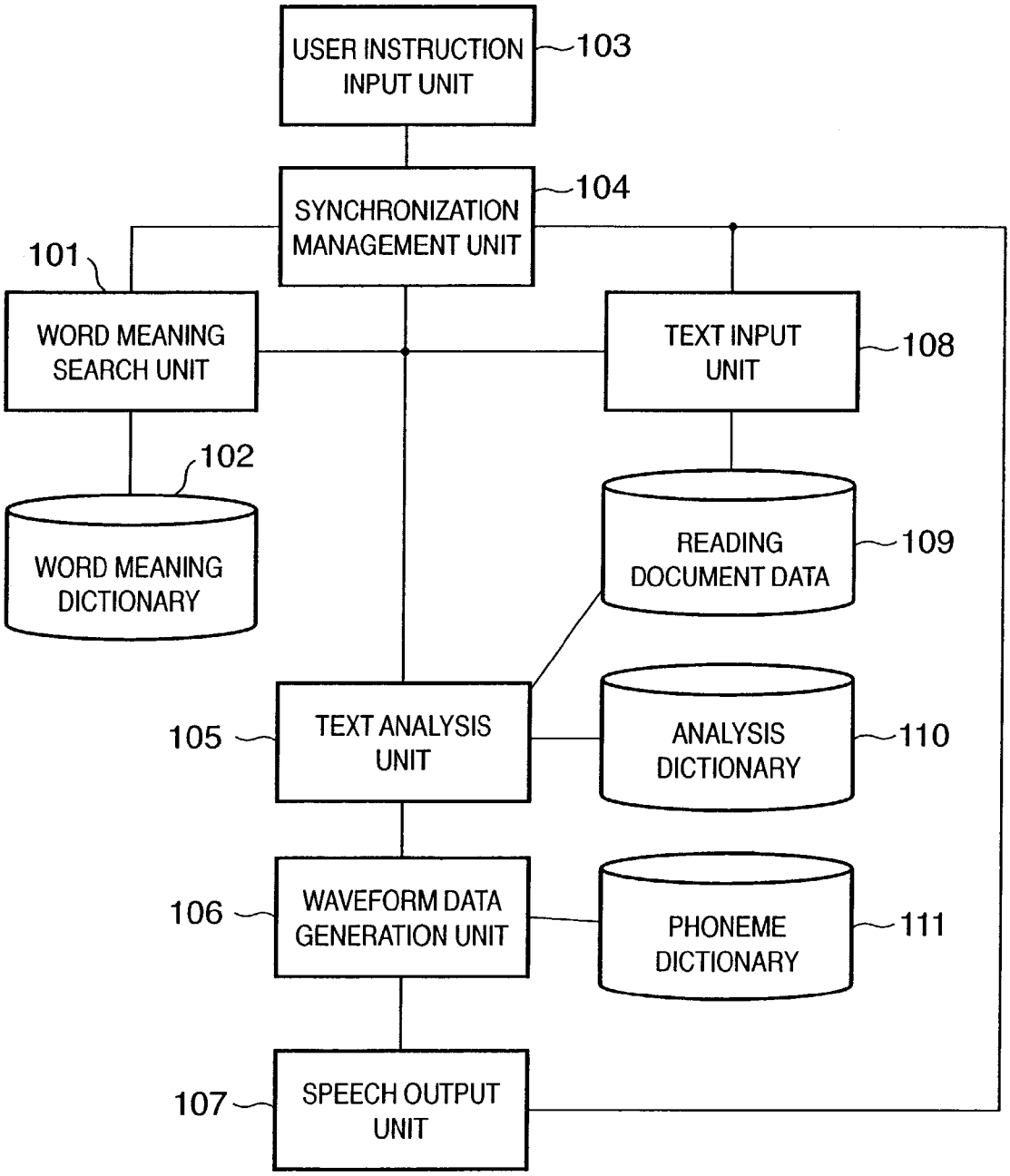
FIG. 1 is a block diagram showing the functional arrangement of a speech synthesis apparatus according to an embodiment of the present invention.

FIG. 1 is a block diagram showing the functional arrangement of a speech synthesis apparatus according to an embodiment of the present invention.

Reference numeral 101 denotes a word meaning search unit, which searches for the meaning of a word. Reference numeral 102 denotes a word meaning dictionary, which stores key words and meanings of various words. Reference numeral 103 denotes a user instruction input unit used to input user's instructions that include various requests such as reading start/stop requests, a word meaning explanation request, and the like for reading document data 109.

Note that the user instruction input unit 103 is implemented by, e.g., buttons arranged on a terminal, or a speech input.

Reference numeral 104 denotes a synchronization management unit which monitors a user's instruction, and a message such as a reading speech output end message, and the like, and manages their synchronization. Reference numeral 105 denotes a text analysis unit which receives reading text data 109 and word meanings, and makes language analysis of them.

Reference numeral 106 denotes a waveform data generation unit which generates speech waveform data on the basis of the analysis result of the text analysis unit 105. Reference numeral 107 denotes a speech output unit which outputs waveform data as sound.

Reference numeral 108 denotes a text input unit which extracts a reading objective unit (e.g., one sentence) from reading document data 109, and sends the extracted data to the text analysis unit 105. The reading objective unit is not limited to a sentence, but may be a paragraph or row.

Reference numeral 109 denotes reading document data. This reading document data 109 may be pre-stored, or data stored in a storage medium such as a DVD-ROM/RAM, CD-ROM/R/RW, or the like may be registered via an external storage device. Also, data may be registered via a network such as the Internet, telephone line, or the like.

Reference numeral 110 denotes an analysis dictionary used in text analysis. Reference numeral 111 denotes a phoneme dictionary which stores a group of phonemes used in the waveform data generation unit 106.

Note that the speech synthesis apparatus has standard building components (e.g., a CPU, RAM, ROM, hard disk, external storage device, microphone, loudspeaker, network interface, display, keyboard, mouse, and the like), which are equipped in a versatile computer.

Various functions of the speech synthesis apparatus may be implemented by executing a program stored in a ROM in the speech synthesis apparatus or in the external storage device by the CPU or by dedicated hardware.

The process to be executed by the speech synthesis apparatus of this embodiment will be described below using FIG. 2.

Figure 2:
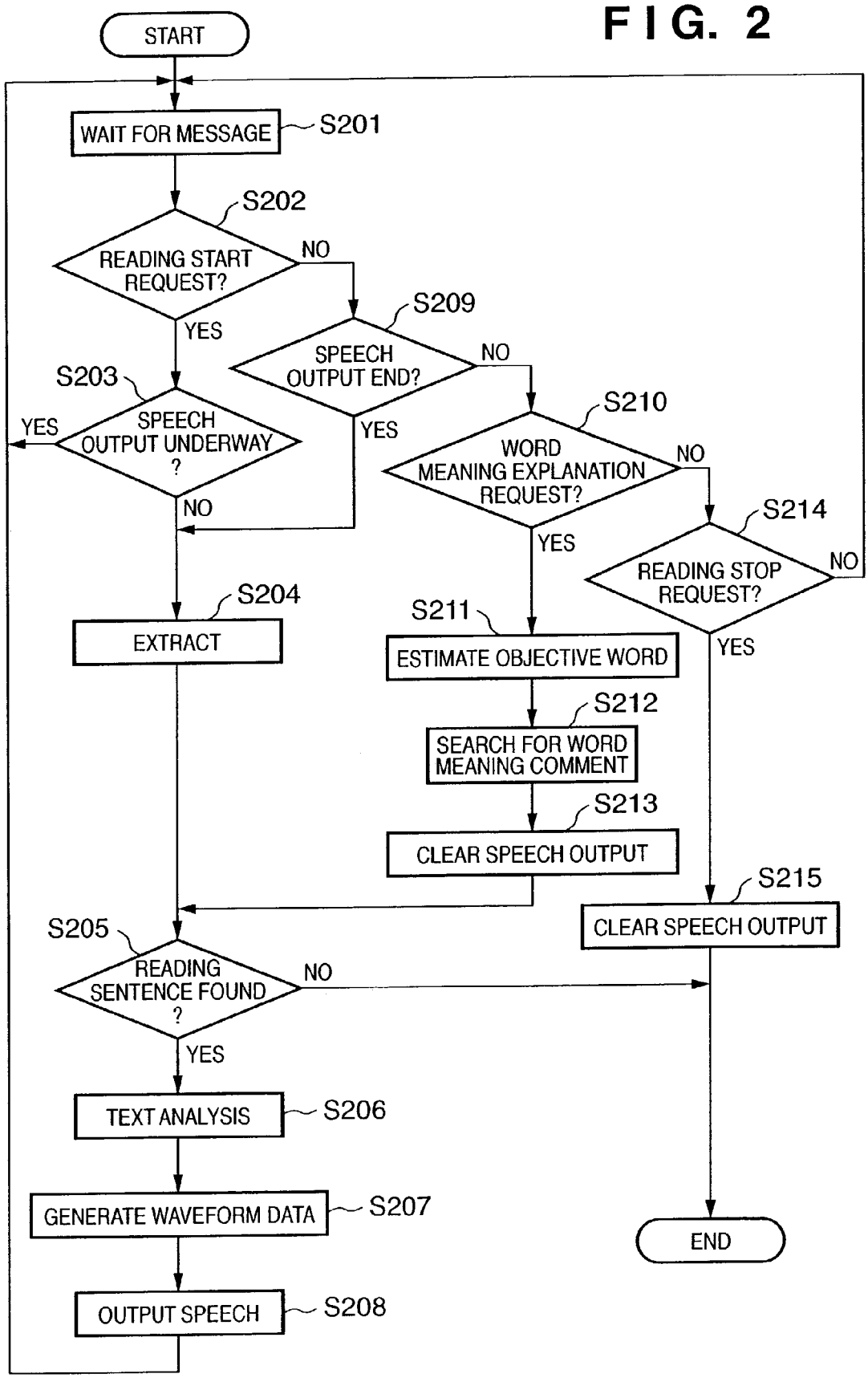
FIG. 2 is a flow chart showing a process to be executed by the speech synthesis apparatus according to the embodiment of the present invention.

FIG. 2 is a flow chart showing the process to be executed by the speech synthesis apparatus according to the embodiment of the present invention.

Note that the flow chart of FIG. 2 starts in response to a reading start request, and comes to an end in response to a reading stop request in this embodiment.

In step S201, the control waits for a message from the user instruction input unit 103. This process is implemented by the synchronization management unit 104 in FIG. 1, which always manages input of a user's instruction, and end of a message such as end of speech output or the like. The control branches to the following processes depending on the message detected in this step.

The synchronization management unit 104 checks in step S202 if the message is a reading start request. If the message is a reading start request (yes in step S202), the flow advances to step S203 to check if speech output is currently underway. If the speech output is underway (yes in step S203), the flow returns to step S201 to wait for the next message, so as not to disturb output speech.

On the other hand, if no speech is output (no in step S203), the flow advances to step S204, and the text input unit 108 extracts a reading sentence from the reading document data 109. Note that the text input unit 108 extracts one reading sentence from the reading document data 109, as described above. Analysis of reading text is done for each sentence, and the read position is recorded in this case.

The text analysis unit 105 checks the presence/absence of a reading sentence in step S205. If no reading sentence is found (no in step S205), i.e., if text is extracted from the reading document data for sentence by sentence, and is read aloud to its end, it is determined that no reading sentence remains, and the process ends.

On the other hand, if a reading sentence is found (yes in step S205), the flow advances to step S206, and the text analysis unit 106 analyzes that reading sentence. Upon completion of text analysis, waveform data is generated in step S207. In step S208, the speech output unit 107 outputs speech based on the generated waveform data. When speech data is output to the end of text, a speech output end message is sent to the synchronization management unit 104, and the flow returns to step S201.

Note that the text analysis unit 105 holds the analysis result of the reading sentence, and records the reading end position of a word in the reading text.

A series of processes in steps S206, S207, and S208 are executed in an independent thread or process, and the flow returns to step S201 before the end of processes, when step S206 starts.

On the other hand, if it is determined in step S202 that the message is not a reading start request (no in step S202), the flow advances to step S209, and the synchronization management unit 104 checks if the message is a speech output end message. If the message is a speech output end message (yes in step S209), the flow advances to step S204 to continue text-to-speech reading.

On the other hand, if the message is not a speech output end message (no in step S209), the flow advances to step S210, and the synchronization management unit 104 checks if the message is a word meaning explanation request. If the message is a word meaning explanation request (yes in step S210), the flow advances to step S211, and the text analysis unit 105 analyzes the already output document data, which has been output as speech immediately before the word meaning explanation request is input, and estimates a word meaning explanation request objective word from that already output document data.

The text analysis unit 105 checks the text analysis result and a word at the reading end position in the sentence, the speech output of which is in progress, thereby identifying an immediately preceding word. For example, if the user issues a word meaning explanation request during reading of the reading text shown in FIG. 3, it is determined that the word meaning explanation request is input at a word "had" which is read aloud at that time.

After the word meaning explanation request objective word is estimated, the word meaning search unit 101 searches for a word meaning comment corresponding to that word meaning explanation request objective word in step S212. Like in a normal electronic dictionary, a word meaning dictionary that stores pairs of key words and their word meaning comment is held, and a word meaning comment is extracted based on the key word. In case of conjugational words such as verbs and the like, since a key word is identified using the text analysis result, even when a continuative of a verb is designated, the verb can be identified as a key word. Note that coupling of an inflectional ending to a particle or the like is a feature of a language called an agglutinative language (for example, Japanese, Ural-Altaic).

English has no such coupling of an ending to a particle, but has inflections such as a past tense form, progressive form, past perfect form, use in third person, and the like.

For example, for "has" in "He has the intent to murder", the word meaning dictionary must be consulted using "have". If a noun has different singular and plural forms, the word meaning dictionary must be consulted using a singular form in place of a plural form. Such inflection process is executed by the text analysis unit to 105 identify a word registered in the dictionary, and to consult the dictionary.

If the word meaning explanation request objective word is not registered in the word meaning dictionary in word meaning search, a message "the meaning of this word is not available" is output in place of the word meaning comment.

After the word meaning search, the synchronization management unit 104 clears, i.e., cancels speech output if the speech output is underway, in step S213.

After that, the word meaning comment is set as the word meaning search result as a reading sentence, and the presence of that sentence is confirmed in step S205. Then, a series of processes in steps S206, S207, and S208 are executed in an independent thread or process, and the flow returns to step S201 before the end of processes, when step S206 starts.

Upon completion of speech output of this word meaning comment, a speech output end message is sent to the synchronization management unit 104, and the flow returns to step S201. Then, in step S204 text-to-speech reading restarts from the sentence immediately after the word meaning explanation request was sent.

On the other hand, if it is determined in step S210 that the message is not a word meaning explanation request (no in step S210), the flow advances to step S214, and the synchronization management unit 104 checks if the message is a reading stop request. If the message is not a reading stop request (no in step S214), such message is ignored as one whose process is not specified, and the flow returns to step S201 to wait for the next message.

On the other hand, if the message is a reading stop request (yes in step S214), the flow advances to step S215, and the synchronization management unit 104 stops output if speech output is underway, thus ending the process.

As described above, according to this embodiment, when the user wants to refer to a given word in a reading sentence, he or she can designate that word to be referred to by a word meaning explanation request without observing display of that sentence, and can immediately confirm the meaning of the word to be referred to.

In the above embodiment, a word which is output as speech immediately before the word meaning explanatory request is determined as a word meaning explanatory request objective word. However, a time lag may be generated from when the user listens to output speech and finds an unknown word until he or she generates a word meaning explanatory request by pressing, e.g., a help button. Hence, as in word meaning explanation 2 in FIG. 3, a word meaning explanation request objective word may be estimated by tracing the sentence from the input timing of the word meaning explanation request.

For example, word meaning explanation inapplicable flags may be appended to a word with a high abstract level, a word with a low importance or difficulty level, and a word such as a particle or the like that works functionally, and word meaning explanation inapplicable words are excluded by tracing words as the text analysis result one by one. In word meaning explanation 2 in FIG. 3, a word meaning explanation request objective word is estimated while tracing back to "accused" by removing "had".

Note that the word meaning explanation inapplicable flag may be held in, e.g., the analysis dictionary 110, and may be attached as an analysis result.

Also, the number of words stored in the word meaning dictionary 102 may be decreased in advance, and a word search may be repeated until a word registered in the word meaning dictionary 102 to be searched can be found.

As shown in word meaning explanation 3 in FIG. 3, the first word meaning explanation request may be determined as a request for specifying an objective sentence, and respective words of the reading sentence may be separately read aloud at an output speed lower than the previous output speed. Upon detection of the second word meaning explanation request, a word immediately before that request may be determined as a word meaning explanation objective word.

Figure 4A:
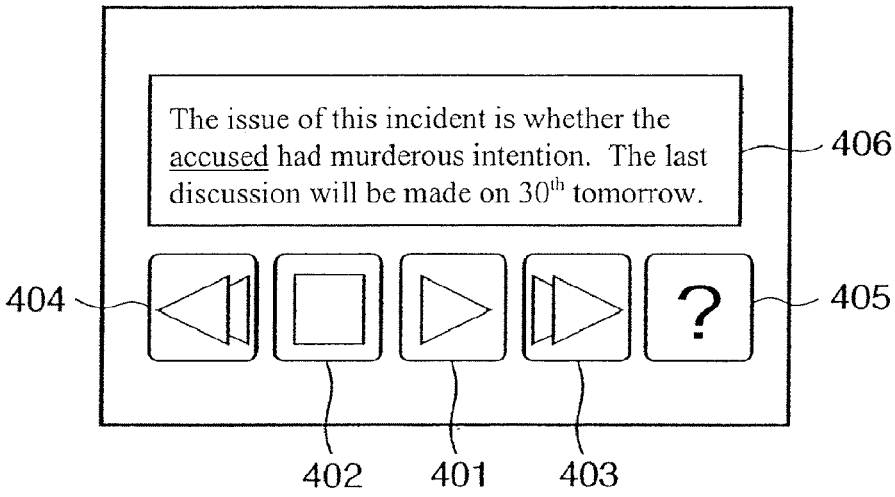
FIGS. 4A to 4C are views showing an application example of the embodiment of the present invention.
Figure 4B:
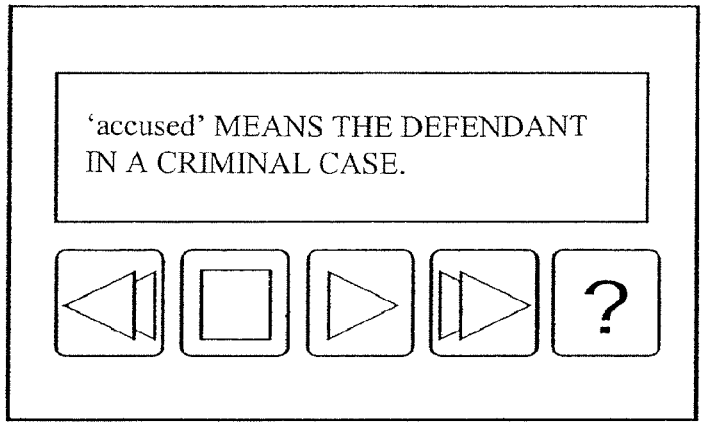
Figure 4C:
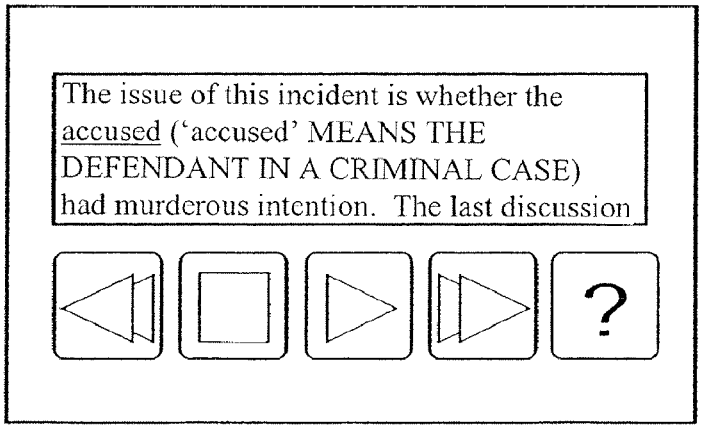

In this embodiment, a word meaning comment is read aloud as speech, but may be displayed on a screen as text. FIGS. 4A to 4C show such an example. FIGS. 4A to 4C show the outer appearance on a portable terminal, which has various user instruction buttons 401 to 405 used to designate start, stop, fast-forward, and fast-reverse of text-to-speech reading, word meaning help, and the like, and a text display unit 406 for displaying reading text.

When the user issues a word meaning explanation request by pressing the "? (help) " button 405 during reading in FIG. 4A, text-to-speech reading is interrupted, and a word meaning comment is displayed, as shown in FIG. 4B. When the user presses the "?" button 405 or "start" button 402 after word meaning explanation, the contents displayed on the screen are restored, and text-to-speech reading restarts.

Also, as shown in FIG. 4C, a word meaning comment may be embedded in a document, text-to-speech reading of which is underway, and may be displayed together.

Note that the button used to issue the word meaning explanation request may be arranged not only on the main body but also at a position where the user can immediately press the button, e.g., at the same position as a remote button.

In the above embodiment, the word meaning dictionary 102 is independently held and used in the apparatus. Alternatively, a commercially available online dictionary, which runs as an independent process, may be used in combination. In this case, a key word is passed to that dictionary to receive a word meaning comment, and a character string of that word meaning comment may be read aloud.

Upon extracting a sentence immediately before the word meaning explanation request, the extraction position may be returned to the head of the sentence in which the word meaning explanation request was issued, and text-to-speech reading may restart from that sentence again.

The embodiments have been explained in detail, but the present invention may be applied to a system constituted by a plurality of devices or an apparatus consisting of a single device.

Note that the present invention includes a case wherein the invention is achieved by directly or remotely supplying a program of software that implements the functions of the aforementioned embodiments (a program corresponding to the flow chart shown in FIG. 2 in the embodiment) to a system or apparatus, and reading out and executing the supplied program code by a computer of that system or apparatus. In this case, software need not have the form of a program as long as it has the program function.

Therefore, the program code itself installed in a computer to implement the functional process of the present invention using the computer implements the present invention. That is, the present invention includes the computer program itself for implementing the functional process of the present invention.

In this case, the form of program is not particularly limited, and an object code, a program to be executed by an interpreter, script data to be supplied to an OS, and the like may be used as long as they have the program function.

As a recording medium for supplying the program, for example, a floppy disk (registered mark), hard disk, optical disk, magnetooptical disk, MO, CD-ROM, CD-R, CD-RW, magnetic tape, nonvolatile memory card, ROM, DVD (DVD-ROM, DVD-R), and the like may be used.

As another program supply method, the program may be supplied by establishing connection to a home page on the Internet using a browser on a client computer, and downloading the computer program itself of the present invention or a compressed file containing an automatic installation function from the home page onto a recording medium such as a hard disk or the like. Also, the program code that forms the program of the present invention may be segmented into a plurality of files, which may be downloaded from different home pages. That is, the present invention includes a WWW server which makes a plurality of users download a program file required to implement the functional process of the present invention by the computer.

Also, a storage medium such as a CD-ROM or the like, which stores the encrypted program of the present invention, may be delivered to the user, the user who has cleared a predetermined condition may be allowed to download key information that can be used to decrypt the program from a home page via the Internet, and the encrypted program may be executed using that key information to be installed on a computer, thus implementing the present invention.

The functions of the aforementioned embodiments may be implemented not only by executing the readout program code by the computer but also by some or all of actual processing operations executed by an OS or the like running on the computer on the basis of an instruction of that program.

Furthermore, the functions of the aforementioned embodiments may be implemented by some or all of actual processes executed by a CPU or the like arranged in a function extension board or a function extension unit, which is inserted in or connected to the computer, after the program read out from the recording medium is written in a memory of the extension board or unit.

The present invention is not limited to the above embodiments, and various changes and modifications can be made within the spirit and scope of the present invention. Therefore, to apprise the public of the scope of the present invention, the following claims are made.

What is claimed is:

1. A speech synthesis apparatus for outputting document data as speech, comprising:

input means for inputting a word meaning explanation request to a word in the document data which is output as speech;

analysis means for, when the word meaning explanation request is input, sentence analyzing already output document data, which is output as speech immediately before the word meaning explanation request is input; and output means for outputting a word meaning comment corresponding to a word meaning explanation request objective word, which is output as speech immediately before the word meaning explanation request is input, obtained based on an analysis result of said analysis means.

2. The apparatus according to claim 1, wherein when the word meaning explanation request is input, said output means re-outputs the already output document data at an output speed lower than a previous output speed, and said analysis means analyzes the already output document data on the basis of the word meaning explanation request input with respect to the already output document data, which is re-output.

3. The apparatus according to claim 1, wherein said analysis means estimates a word meaning explanation request objective word from a word group other than a predetermined word in the already output document data.

4. The apparatus according to claim 3, wherein the predetermined word is a word having a word meaning explanation inapplicable flag.

5. The apparatus according to claim 3, wherein the predetermined word is a word having a part of speech other than at least a noun.

6. A speech synthesis method for outputting document data as speech, comprising:

an input step of inputting a word meaning explanation request to a word in the document data which is output as speech;

an analysis step of sentence analyzing, when the word meaning explanation request is input, already output document data, which is output as speech immediately before the word meaning explanation request is input; and an output step of outputting a word meaning comment coffesponding to a word meaning explanation request objective word, which is output as speech immediately before the word meaning explanation request is input, obtained based on an analysis result of the analysis step.

7. The method according to claim 6, wherein the output step includes a step of re-outputting, when the word meaning explanation request is input, the already output document data at an output speed lower than a previous output speed, and the analysis step includes a step of analyzing the already output document data on the basis of the word meaning explanation request input with respect to the already output document data, which is re-output.

8. The method according to claim 6, wherein the analysis step includes a step of estimating a word meaning explanation request objective word from a word group other than a predetermined word in the already output document data.

9. The method according to claim 8, wherein the predetermined word is a word having a word meaning explanation inapplicable flag.

10. The method according to claim 8, wherein the predetermined word is a word having a part of speech other than at least a noun.

11. A computer-readable storage medium storing computer executable instructions for causing a computer to output synthesized speech representing document data as speech, comprising:

an input step of inputting a word meaning explanation request to a word in the document data which is output as speech;

an analysis step of sentence analyzing, when the word meaning explanation request is input, already output document data, which is output as speech immediately before the word meaning explanation request is input; and an output step of outputting a word meaning comment coffesponding to a word meaning explanation request objective word, which is output as speech immediately before the word meaning explanation request is input, obtained based on an analysis result of the analysis step.

12. A speech synthesis apparatus, comprising:

speech output means for synthesizing document data to output as speech;

second speech output means for, when a word meaning explanation request to a word in the document data output as speech is input during speech output by said speech output means, reading aloud respective words of a read sentence in the document data separately at an output speed lower than a previous output speed;

analysis means for, when a word meaning explanation request to a word in the document data output as speech is input during speech output by said second speech output means, sentence analyzing the already output document data, which is output as speech immediately before the word meaning explanation request is input; and output means for outputting a word meaning comment coffesponding to a word meaning explanation request objective word, which is output as speech immediately before the word meaning explanation request is input, obtained based on an analysis result of said analysis means.

13. A speech synthesis method, comprising:

a speech output step of synthesizing document data to output as speech;

a second speech output step of, when a word meaning explanation request to a word in the document data output as speech is input during speech output in said speech output step, reading aloud respective words of a read sentence in the document data separately at an output speech lower than a previous output speed;

an analysis step of, when a word meaning explanation request to a word in the document data output as speech is input during speech output in said second speech output step, sentence analyzing the already output document data, which is output as speech immediately before the word meaning explanation request is input; and an output step of outputting a word meaning comment coffesponding to a word meaning explanation request objective word, which is output as speech immediately before the word meaning explanation request is input, obtained based on an analysis result of said analysis step.

14. A computer-readable storage medium storing computer executable instructions for causing a computer to output synthesized speech representing document data as speech, comprising:

a speech output step of synthesizing document data to output as speech;

a second speech output step of, when a word meaning explanation request to a word in the document data output as speech is input during speech output in said speech output step, reading aloud respective words of a read sentence in the document data separately at an output speed lower than a previous output speed;

an analysis step of, when a word meaning explanation request to a word in the document data output as speech is input during speech output in said second speech output step, sentence analyzing the already output document data, which is output as speech immediately before the word meaning explanation request is input; and an output step of outputting a word meaning comment coffesponding to a word meaning explanation request objective word, which is output as speech immediately before the word meaning explanation request is input, obtained based on an analysis result of said analysis step.

* * * * *

UNITED STATES PATENT AND TRADEMARK OFFICE

CERTIFICATE OF CORRECTION

PATENT NO. : 7,353,175 B2
APPLICATION NO. : 10/376205
DATED : April 1, 2008
INVENTOR(S) : Kaneko It is certified that error appears in the above-identified patent and that said Letters Patent is hereby corrected as shown below:

COLUMN 8:
Line 52, "said" should read --¶said--.

COLUMN 9:
Line 12, "coffesponding" should read --corresponding--.
Line 49, "coffesponding" should read --corresponding--.

COLUMN 10:
Line 9, "coffesponding" should read --corresponding--.
Line 31, "coffesponding" should read --corresponding--.
Line 56, "coffesponding" should read --corresponding--.

Signed and Sealed this

Twenty-eighth Day of October, 2008

JON W. DUDAS
*Director of the United States Patent and Trademark Office*